United States Patent [19]

Munn et al.

[11] 4,116,355

[45] Sep. 26, 1978

[54] DINING UTENSIL

[76] Inventors: John W. Munn; Kevin J. Munn, both of 4815 Montibello Dr., Charlotte, N.C. 28211

[21] Appl. No.: 730,656

[22] Filed: Oct. 7, 1976

[51] Int. Cl.[2] ..... A47J 43/28; B65D 7/42

[52] U.S. Cl. ..... 220/83; 30/323; 220/20; 220/23.4; 220/85 R; D7/27; D7/39; D7/129

[58] Field of Search ..... 220/85 R, 83; 99/506–508; D7/27, 48, 49, 129, 90, 39, 130, 157; 30/322–328

[56] References Cited

U.S. PATENT DOCUMENTS

| | | | |
|---|---|---|---|
| D. 54,298 | 12/1919 | Zizelman | D7/148 |
| D. 199,072 | 9/1964 | Lewis | D7/27 |
| D. 228,604 | 10/1973 | Press | D7/27 |
| 273,154 | 2/1883 | Ray et al. | 30/322 |
| 283,634 | 8/1883 | Meyer | 30/125 |
| 344,506 | 6/1886 | Strans | D7/48 |
| 529,764 | 11/1894 | Weeks | D7/157 |
| 704,139 | 7/1902 | Stadelman | 220/85 R |
| 1,075,119 | 10/1913 | Reichner | 99/508 |
| 1,168,032 | 1/1916 | Reichner | 99/508 |
| 1,941,164 | 12/1933 | Ciampg | 99/508 |
| 2,602,686 | 7/1952 | Gibbons | 30/324 |
| 2,701,593 | 2/1955 | Dootson | D7/48 |
| 2,813,509 | 11/1957 | Bruno | 220/69 |
| 2,974,820 | 3/1961 | Romei | 220/85 R |

FOREIGN PATENT DOCUMENTS

| | | | |
|---|---|---|---|
| 109,884 | 3/1940 | Australia | 99/508 |
| 955,031 | 6/1949 | France | 30/322 |
| 737,471 | 6/1943 | Fed. Rep. of Germany | 30/322 |

*Primary Examiner*—William Price
*Assistant Examiner*—Allan N. Shoap
*Attorney, Agent, or Firm*—Ralph H. Dougherty

[57] ABSTRACT

A dining utensil for use in eating and cooking fondue. The utensil includes a device for assisting engagement of food such as meat, fowl, seafood, fruit or bread by a fondue fork and for disengaging cooked food from the same fork.

5 Claims, 17 Drawing Figures

DINING UTENSIL

BACKGROUND OF THE INVENTION

Fondue is widely enjoyed as a leisurely meal whereby the diners cook their own meat, fowl or seafood and often other items in a common pot filled with oil called a fondue pot. Each item to be cooked is impaled on a fork and placed in the boiling oil for a short period of time. When meat is the item to be cooked, it must be firmly impaled upon the fork, for upon cooking it will contract and work its way off the tines of the fork, dropping into the pot from whence it is extremely difficult to be recovered. Currently available fondue dishes have small ridges or separators which divide the dish into a number of compartments, normally for containing and confining sauces. When a diner attempts to impale a piece of meat on a fork by pushing it against one of these ridges, he usually fails. The meat slides over the separator into the next compartment covering it with sauce. When the meat is ultimately placed into the pot a scum forms on and contaminates the fondue oil. Sometimes a residue tends to accumulate in the bottom of the fondue pot causing it to intermittently boil over. It is not uncommon for diners to pick up the meat with fingers and attempt to impale it on the fork by pushing with fingers. This often results in injury to the diner when the tines of the fork pass through the meat and into the hand, usually into the meaty part of the palm by the thumb. Besides being uncomfortable to the one so injured, it usually produces a great mass of blood rendering dining extremely difficult and messy.

OBJECTS OF THE INVENTION

It is the principal object of this invention to provide a dining utensil useful for impaling food on a fondue fork.

It is another object of this invention to provide a dining utensil for assisting in the removal of food from a fondue fork.

It is also an object of this invention to provide a dining utensil for use with fondue which will prevent injury of the diner by offering an alternative to placing meat on the fork with fingers.

It is also an object of this invention to provide a means for preventing contamination of food by sauces before entering the cooking pot.

It is another object to provide a fondue dining plate having incorporated or removable food engaging means.

SUMMARY OF THE INVENTION

The invented dining apparatus comprises a base having a series of substantially upstanding ribs which may take several forms. The upstanding ribs constitute the fondue meat engaging means. The utensil may also have a notch suitable for disengaging cooked fondue meat from a fork. The utensil may be fixed to a plate, integral therewith, or removably attached thereto.

DETAILED DESCRIPTION

Figure 1:
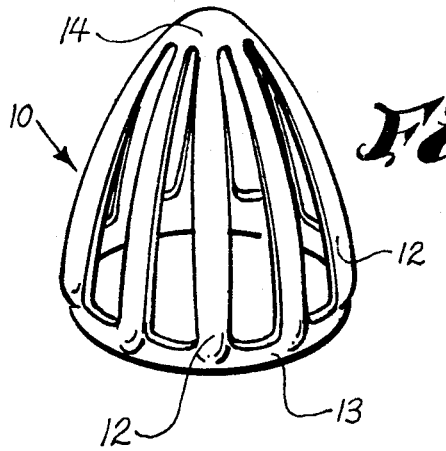
FIG. 1 is an elevational view of the simplest form of the invented dining utensil.
Figure 2:
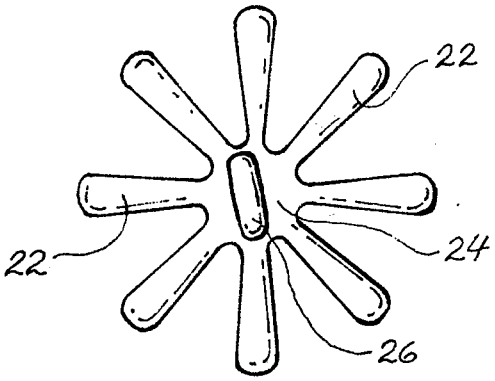
FIG. 2 is a plan view of an alternative utensil.

Referring now to the drawings and more particularly to FIGS. 1 and 2, among the simplest forms of fondue-engaging utensils is hand held fondue pusher 10 which has a series of upstanding ribs 12 connected both at their base 13 and their vertex 14. A suitable design includes that depicted in FIG. 2, in which upstanding ribs 22 are generally radial from upstanding central stem 24 when viewed in plan or in horizontal cross section. Means 26 for holding with fingers may be incorporated in the embodiments of either FIG. 1 or FIG. 2.

Figure 3:
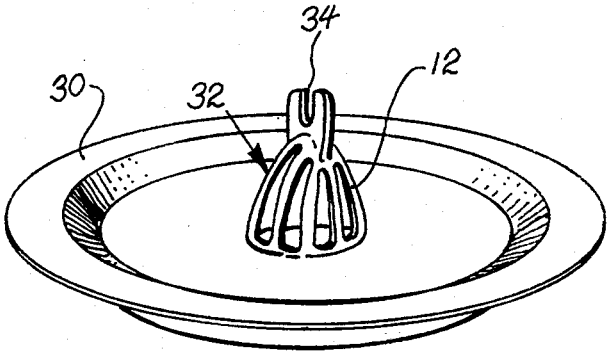
FIG. 3 is an isometric view of the fondue dish, or plate showing another alternative utensil affixed thereto.

Fondue dish 30 of FIG. 3 has a fondue-engaging element 32 fixed in the bowl thereof. This element contains a pair of upstanding members 34 horizontally spaced to allow the passage of a fork therebetween, but spaced sufficiently close together to prevent the passage of anything impaled upon the fork.

Figure 4:
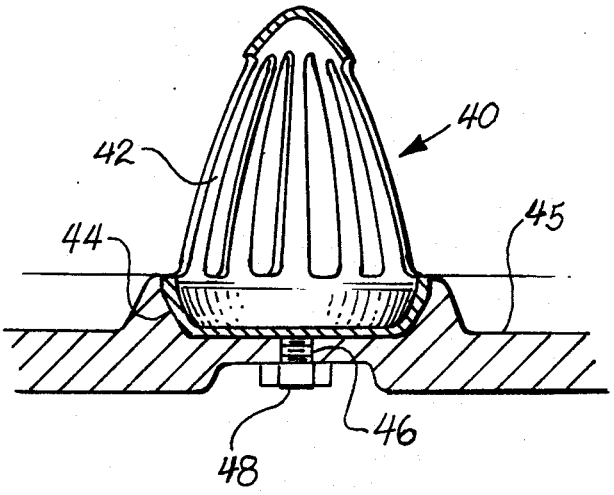
FIG. 4 is a sectional, partially cut-away view through the center of the plate of FIG. 3 showing a modified utensil affixed thereto.

FIG. 4 shows a meat-engaging means 40 having radially-spaced ribs 42 positioned in recess 44 of plate 45. A downwardly projecting threaded member 46 protrudes through the plate and is held thereto by a retaining nut 48.

Figure 5:
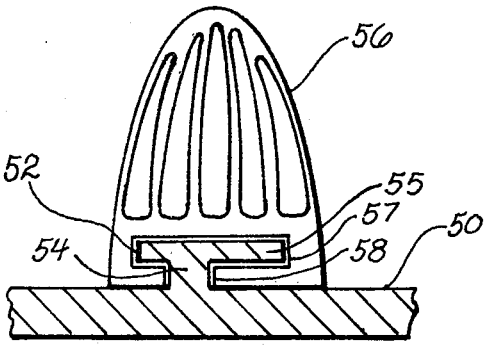
FIG. 5 is a sectional view of an alternative utensil removably fixed to a plate.
Figure 6:
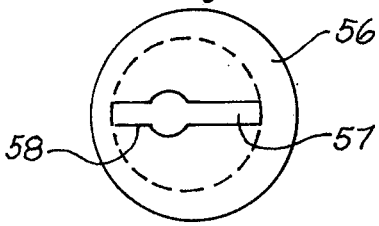
FIG. 6 is a bottom view of the utensil of FIG. 5.

In the embodiment of FIG. 5, plate 50 has an upstanding utensil engaging means 52 which includes a stem 54 and an elongated retaining lock 55. Utensil 56 has a recess 57 and an elongated bottom slot 58 communicating with the recess. The slot 58 of utensil 56 fits over the elongated lock 52, then the utensil is twisted to firmly fix it onto the engaging means. Note that stem 54 is off center from the lock 55. FIG. 6 shows the off center relationships more clearly.

Figure 7:
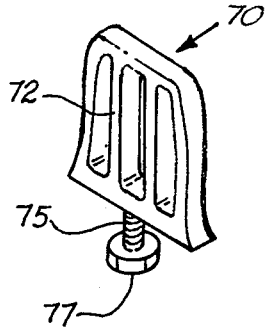
FIG. 7 is an isometric view of another alternative utensil for attachment to a plate.

An alternative utensil to that of FIG. 4 is device 70 of FIG. 7 in which a minimum number of upstanding ribs 72 are interconnected generally in a single plane, alternatively, the device may be curved. The depth of the device may be less than the spacing of the tines of the fork to be used with the fondue dish. The width of the ribs is also slightly less than the tine spacing of a fondue fork. The device also includes a downwardly protruding threaded member 75 for engagement to a plate and retention thereto by a nut 77.

Figure 8:
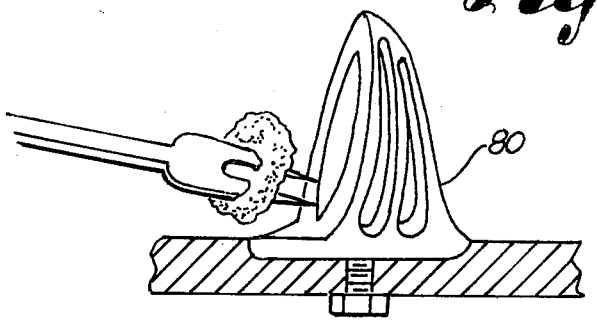
FIG. 8 is a partially sectioned elevational view of yet another alternative utensil fastened to a plate.

Utensil 80 of FIG. 8 is similar to utensil 40 but has fewer ribs, thus leaving one side open on the utensil. This allows meat to be placed within the utensil before impaling it on a fork and allows meat to be scraped off the fork on the open side of the utensil.

Figure 9:
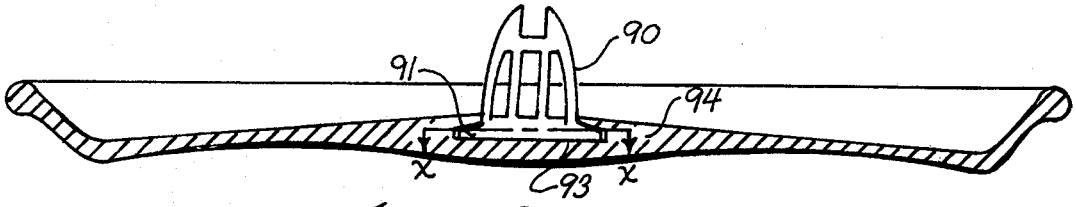
FIG. 9 is a sectional view of a utensil removably attached to a plate.
Figure 10:
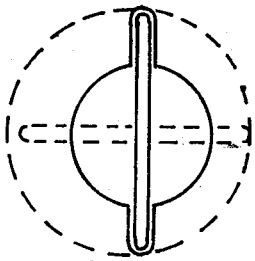
FIG. 10 is a view taken along line X—X of FIG. 9.

The embodiment of FIG. 9 includes a utensil 90 having ears of cams 91 which fit into an offset circular recess 93 in plate 94. The recess 93 accepts the upstanding utensil 90 in position A which, upon twisting to position B, becomes firmly locked into position as shown in FIG. 10.

Figure 11:
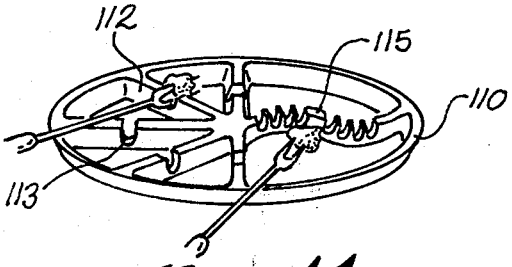
FIG. 11 is an isometric view of a fondue plate incorporating both food-engaging and disengaging means.

Fondue plate 110 depicted in FIG. 11 has compartments defined by separators 112. One or more of the separators is provided with a recess 113 for disengaging food from a fondue fork. One separator 115, shown in serpentine form, has a number of recesses leaving the separator's upstanding members as food engaging means for a fork, each of these upstanding members having a width less than that of the spacing of the fork tines. The spacing may be even closer, but one must engage the meat while the plane of the fork tines is parallel to the upstanding members rather than perpendicular.

Figure 12:
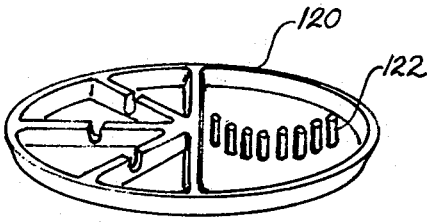
FIG. 12 is an isometric view of an alternative embodiment of the plate of FIG. 11.

FIG. 12 shows an alternative embodiment of the plate of FIG. 11 in which the food-engaging means of plate 120 takes the form of small upstanding cylindrical members 122. These members 122 may have any desired cross section, round, oval, triangular, square, diamond, etc.

Figure 13:
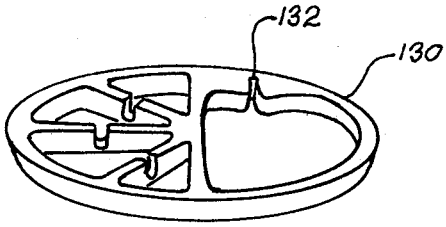
FIG. 13 is an isometric view of an alternative fondue plate having a fork-accepting recess.

An alternative embodiment is plate 130 of FIG. 13 which has a recess 132 built into the plate whereby a fork can be admitted to the recess when impaling meat or other food thereon.

Figure 14:
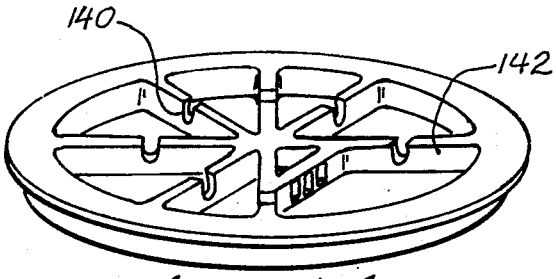
FIG. 14 is an isometric view of an alternative fondue plate with an alternative fork-accepting recess.

Another alternative embodiment, shown in FIG. 14, has recesses 140 in an upstanding member 142, which may be positioned at any desired location on the plate. Cross member 143 is provided with engaging means 144.

Figure 15:
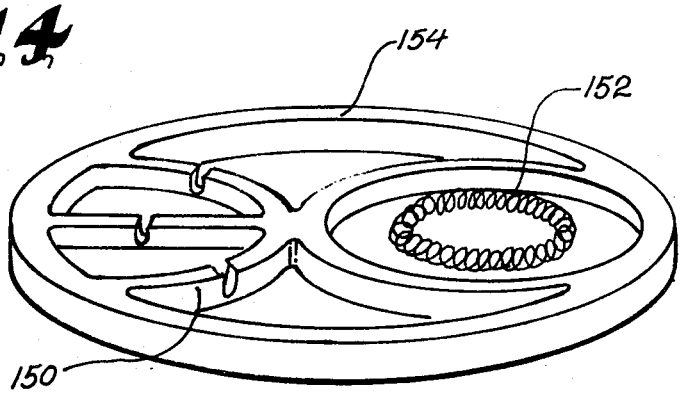
FIG. 15 is an isometric view of an alternative fondue plate incorporating a torus thereon.

The separators 150 of FIG. 15 are in an alternative design. A wire torus 152, fastened to plate 154 by any convenient means, provides a continuous circle of fork engaging means.

Figure 16:
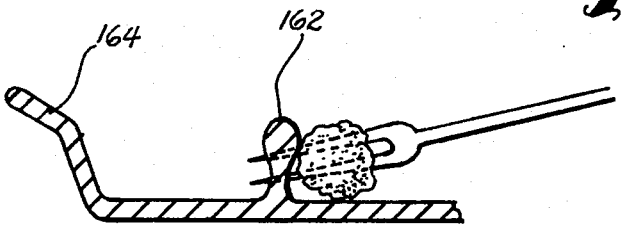
FIG. 16 is a partial cross section of an alternative embodiment.

FIG. 16 shows an alternative embodiment wherein a circle of upstanding fork engaging means 162 can be molded into plate 164.

Figure 17:
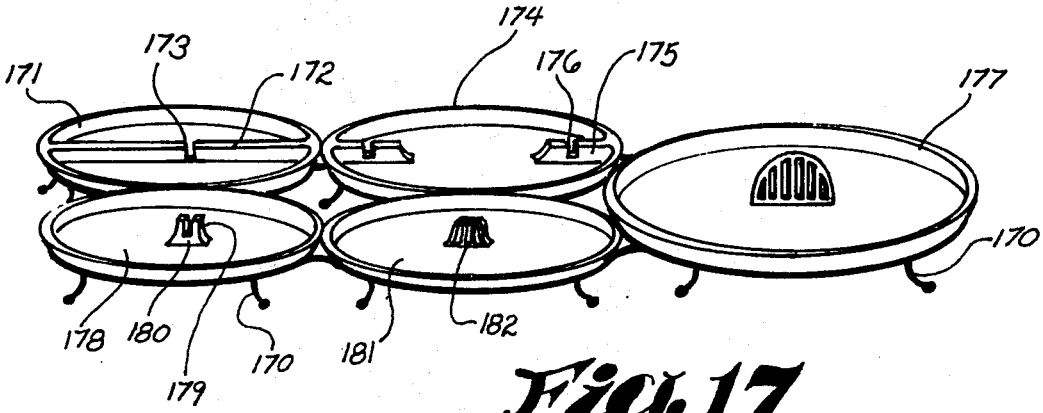
FIG. 17 is an isometric view of an entire fondue set.

An entire fondue set is shown in FIG. 17 as a series of fondue trays or plates arranged in a wire receptacle 170. This set is well suited to a fondue buffet in which a number of various items of meat, fowl, seafood, etc. are available for cooking in one or more adjacently situated fondue pots. Note that each plate depcited in the set includes different fondue engaging means. Plate 171 has only a single diametrical separator 172 provided with a gap 173 which acts as a disengaging means. Plate 174 has two widely separated engaging means 175, each of which is provided with disengaging slot 176. Plate 177 employs the engaging means of FIG. 7 whereas plate 178 employs a narrow upstanding engaging means 179 with a disengaging slot 180 atop it. Plate 181 carries yet another engaging means 182. Alternatively to wire receptical 170 a large tray could be employed having rims or recesses to contain each plate and prevent it from sliding on a table relative to any other plate.

SUMMARY OF THE INVENTION

Note that in every embodiment of the present invention provision is made for receiving a fondue fork after it has passed partially through a piece of meat or other food to be cooked in a fondue pot. In all cases one or more upstanding ribs are affixed to a base. In most instances, the upstanding ribs have a spacing less than that of the tines of the fork to allow food to be readily pushed onto the fork tines. One embodiment includes a spacing between the ribs whereby all tines of the fork can be received into the recess.

While most of the embodiments include a utensil affixed to a plate, this is not absolutely essential as the fondue engaging utensil can be a finger held item.

It is readily apparent from the foregoing that this invention provides a dining utensil useful for impaling food on a fondue fork, useful for assisting in the removal of food from a fork and which will prevent injury to the diner when properly used.

It is to be understood that the foregoing description and specific examples are illustrated of the principles of the invention and that various other modifications and additions may be made thereto by those skilled in the art without departing from the spirit and scope of the invention as set forth in the following claims.

What is claimed is:

1. A dining utensil for use in engaging a food particle on the tines of a fork, said utensil comprising:

(a) a base, having a flat bottom surface;

(b) a multiplicity of vertical ribs connected to said base and meeting at their upper ends to form a vertex, each of said ribs extending at least partially radially outward from said base; and (c) a pair of horizontally spaced, substantially parallel upstanding members fixed to the vertex of said utensil and spaced apart slightly more than the spacing of the tines of a fork to be used therewith.

2. A dining utensil according to claim 1 wherein said ribs extend generally radially from said base.

3. Apparatus according to claim 2 further comprising means for attaching said utensil to a plate.

4. A dining utensil according to claim 3 wherein said attaching means is downwardly extending member adapted to be received by a hole in a plate.

5. A utensil according to claim 4 wherein said downwardly extending member is threaded for engagement by a nut.

* * * * *